US010107159B2

(12) United States Patent
Kurosaka

(10) Patent No.: US 10,107,159 B2
(45) Date of Patent: Oct. 23, 2018

(54) INTERNAL COMBUSTION ENGINE

(71) Applicant: TOYOTA JIDOSHA KABUSHIKI KAISHA, Toyota-shi, Aichi-ken (JP)

(72) Inventor: Tetsuya Kurosaka, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 116 days.

(21) Appl. No.: 15/328,198

(22) PCT Filed: Jul. 28, 2015

(86) PCT No.: PCT/IB2015/001265
§ 371 (c)(1),
(2) Date: Jan. 23, 2017

(87) PCT Pub. No.: WO2016/016705
PCT Pub. Date: Feb. 4, 2016

(65) Prior Publication Data

US 2017/0211436 A1 Jul. 27, 2017

(30) Foreign Application Priority Data

Jul. 31, 2014 (JP) ..... 2014-155907

(51) Int. Cl.
*F01M 9/10* (2006.01)
*F01L 1/053* (2006.01)
(Continued)

(52) U.S. Cl.
CPC ..... *F01M 9/101* (2013.01); *F01L 1/022* (2013.01); *F01L 1/053* (2013.01); *F02B 67/04* (2013.01);
(Continued)

(58) Field of Classification Search
CPC ... F01L 1/022; F01L 1/047; F01L 2001/0537; F01L 1/46; F01L 2810/02; F01M 9/08;
(Continued)

(56) References Cited

U.S. PATENT DOCUMENTS

2014/0230762 A1* 8/2014 Nakashima ..... F01L 1/3442 123/90.12
2014/0326225 A1* 11/2014 Shioda ..... F02C 6/12 123/559.1

FOREIGN PATENT DOCUMENTS

CN 202348508 U 7/2012
JP H04-112975 A 4/1992
(Continued)

*Primary Examiner* — Jorge Leon, Jr.
(74) *Attorney, Agent, or Firm* — Oliff PLC

(57) ABSTRACT

An internal combustion engine includes a camshaft, a cylinder head, a head cover, a high-pressure pump, and a vacuum pump. The high-pressure pump includes a plunger that abuts against a cam provided on the camshaft. The high-pressure pump is configured to be driven by rotation of the cam such that oil that has lubricated abutting portions of the cam and the plunger collides with an inside wall of the head cover. The vacuum pump is mounted to the cylinder head. The vacuum pump is configured to draw in air from an inlet and discharge an oil mist with air from an outlet. The outlet is arranged such that the oil mist with air from the outlet is discharged into a space where an oil mist formed by a spray of oil that has collided with the inside wall of the head cover stagnates.

4 Claims, 4 Drawing Sheets

(51) Int. Cl.

| | |
|---|---|
| ***F02B 67/04*** | (2006.01) |
| ***F02M 59/10*** | (2006.01) |
| ***F01L 1/02*** | (2006.01) |
| *F02F 7/00* | (2006.01) |
| *F01L 1/46* | (2006.01) |
| *F02F 1/24* | (2006.01) |
| *F01M 13/02* | (2006.01) |

(52) U.S. Cl.
CPC ..... *F02M 59/10* (2013.01); *F01L 1/46* (2013.01); *F01L 2001/0537* (2013.01); *F01L 2810/02* (2013.01); *F01M 13/022* (2013.01); *F02F 1/24* (2013.01); *F02F 7/006* (2013.01)

(58) Field of Classification Search
CPC ..... F01M 9/101; F01M 13/00; F01M 2013/0038; F01M 13/022; F01M 13/023; F02F 1/24; F02F 7/006
USPC ..... 123/90.31, 90.34, 90.37, 90.38
See application file for complete search history.

(56) References Cited

FOREIGN PATENT DOCUMENTS

| | | | |
|---|---|---|---|
| JP | H06-123212 | A | 5/1994 |
| JP | 2008-019842 | A | 1/2008 |
| JP | 2012-237234 | A | 12/2012 |
| WO | 2008/010051 | A1 | 1/2008 |
| WO | 2013/080600 | A1 | 6/2013 |

* cited by examiner

INTERNAL COMBUSTION ENGINE

BACKGROUND OF THE INVENTION

1. Field of the Invention

The invention relates to an internal combustion engine.

2. Description of Related Art

Japanese Patent Application Publication No. 2012-237234 (JP 2012-237234 A) describes an internal combustion engine provided with a blow-by gas reduction device that includes an oil separation device that separates oil mist from blow-by gas.

SUMMARY OF THE INVENTION

An internal combustion engine mounted in a vehicle includes a vacuum pump, and increases brake pedal force using negative pressure generated by drawing in air with this vacuum pump. The vacuum pump draws in air from an inlet and discharges air from an outlet, at which time oil that lubricates the sliding points of the vacuum pump may be discharged together with the air. The oil discharged together with the air from the vacuum pump is injected all at once from the outlet together with air pressurized inside an air chamber of the vacuum pump, and thus becomes a mist in which the particle diameter is significantly small. Therefore, in a related oil separation device, the oil mist discharged from the vacuum pump may not be able to be collected.

The invention relates to an internal combustion engine in which oil discharged from a vacuum pump is easily collected.

A first aspect of the invention relates to an internal combustion engine includes a camshaft, a cylinder head, a head cover, a high-pressure pump, and a vacuum pump. The cylinder head supports the camshaft such that the camshaft rotates. The head cover is mounted to the cylinder head. The high-pressure pump includes a plunger that abuts against a cam provided on the camshaft. The high-pressure pump is configured to be driven by rotation of the cam such that oil that has lubricated abutting portions of the cam and the plunger collides with an inside wall of the head cover. The vacuum pump is mounted to the cylinder head. The vacuum pump includes an inlet and an outlet. The vacuum pump is configured to draw in air from the inlet and discharge an oil mist with air from the outlet. The outlet is arranged such that the oil mist with air from the outlet is discharged into a space where an oil mist formed by a spray of oil that has collided with the inside wall of the head cover stagnates.

Oil is supplied to the abutting portions of the plunger of the high-pressure pump driven by the rotation of the cam, and the cam, such that these abutting portions are lubricated. Therefore, oil that has supplied to the cam is dispersed inside the head cover as the cam rotates. The oil dispersed inside the head cover collides with the inside wall of the head cover, and the spray produced at the time of this collision becomes an oil mist that stagnates inside the head cover. This kind of oil mist is produced by the dispersed oil colliding with the inside wall, so the particle diameter of this kind of oil mist is typically larger than that of the oil mist discharged together with pressurized air from the outlet of the vacuum pump.

With the structure described above, the oil mist with a small particle diameter that is discharged together with air from the outlet of the vacuum pump is discharged toward a space where the oil mist formed by the oil dispersed by the cam stagnates. As a result, the oil mist having a small particle diameter collides with the oil mist having a large particle diameter, and consequently, the particle diameter of the oil mist having the small particle diameter becomes larger. That is, the oil mist discharged from the vacuum pump becomes easier to collect. Furthermore, the oil mist and air discharged from the vacuum pump collide with the oil mist formed by the oil dispersed by the cam, so liquefaction of the oil dispersed by the cam is promoted, and the oil mist formed by the oil dispersed by the cam is able to be collected more easily.

In the internal combustion engine according to the aspect described above, the camshaft may include an intake camshaft that drives an intake valve and an exhaust camshaft that drives an exhaust valve. The cylinder head may support the intake camshaft and the exhaust camshaft side by side. The vacuum pump may be connected to one end of one camshaft, from among the intake camshaft and the exhaust camshaft. The high-pressure pump may be driven by a cam arranged in a position closest to the vacuum pump, from among a plurality of cams provided on the other camshaft, from among the intake camshaft and the exhaust camshaft.

According to this structure, The space where the oil mist formed by oil dispersed by the cam that drives the high-pressure pump is closer to the position where the vacuum pump is arranged. Therefore, the oil mist and air discharged from the vacuum pump and the oil mist formed by the oil dispersed by the cam are more apt to collide, so the oil is able to be collected more easily.

The internal combustion engine having the structure described above may also include a chain that drives the camshaft, and a chain cover that covers the chain. Two of the cylinder heads and two of the head covers may be provided. The chain may operatively link a plurality of the camshafts provided in each of the two cylinder heads. One of the two head covers may include an inlet that introduces air in from a portion of an intake passage that is upstream of a position where a throttle valve is provided in the intake passage. The other of the two head covers may include a recirculation port that discharges blow-by gas to a portion of the intake passage that is downstream of the throttle valve in the intake passage, such that blow-by gas flows from the inlet formed in the one of the two head covers to the recirculation port of the other of the two head covers via inside of the chain cover. The vacuum pump and the high-pressure pump may be arranged in a cylinder head to which the one of the two head covers is mounted.

According to this structure, the vacuum pump is arranged in the cylinder head provided with the inlet, so oil mist discharged from the vacuum pump but which did not collide with the oil mist formed by the oil dispersed by the cam that drives the high-pressure pump will flow together with the air that flows through a passage that the blow-by gas flows through. That is, this oil mist will flow from inside the head cover of the cylinder head provided with the inlet into the head cover in the other cylinder head via the inside of the chain cover. As a result, oil mist that did not collide with the oil mist formed from the oil dispersed by the cam that drives the high-pressure pump will collide with droplets of other oil while flowing through the passage that the blow-by gas flows through, the inside walls of the head covers, and the inside wall of the chain cover, and the like, such that the particle diameter will increase and the oil mist will more easily liquefy. Therefore, oil that did not collide with the oil mist formed by the oil dispersed by the cam that drives the high-pressure pump will also be more easily collected.

The internal combustion engine having the structure described above may also include a chain guide that guides the chain. The chain guide may include a discharge hole. The discharge hole may be configured to discharge droplets of oil supplied to lubricate sliding surfaces of the chain and the chain guide into the chain cover through which the blow-by gas flows.

According to this structure, droplets of oil discharged from the discharge hole of the chain guide are able to be made to collide with the oil mist that has flowed together with the blow-by gas that flows through the chain cover. The amount of oil used to lubricate the chain is larger than that used at other lubricating points in the internal combustion engine, and the droplets of oil dispersed from the chain guide have a relatively large particle diameter. Therefore, the particle diameter of the oil mist is able to be made larger by making the droplets of oil with a particle diameter larger than the particle diameter of the oil mist discharged from the vacuum pump, collide with the oil mist discharged from the vacuum pump. That is, the oil mist discharged from the vacuum pump is able to be collected more easily, and the liquefaction of oil discharged from the discharge hole of the chain guide is able to be promoted, so the recovery of oil discharged from the discharge hole of the chain guide is also able to be promoted.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
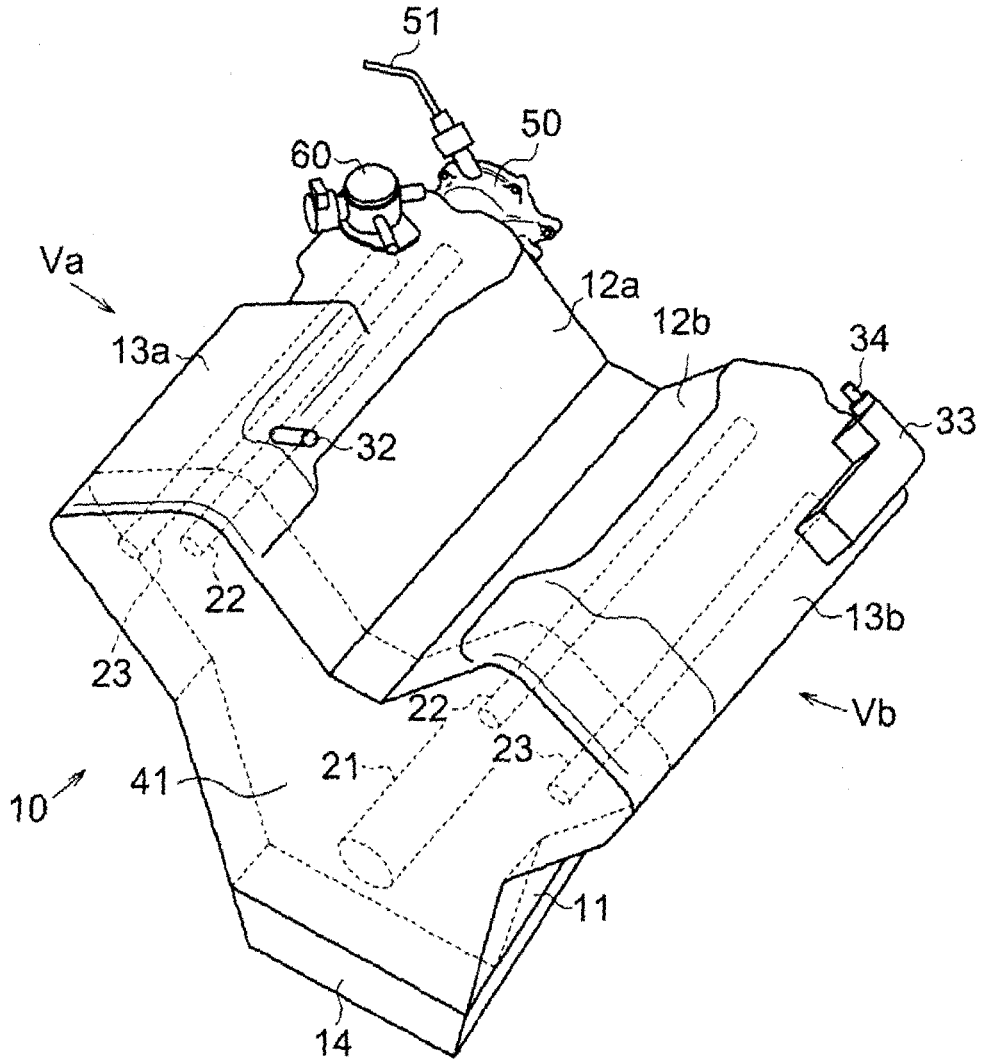
FIG. 1 is a perspective view of an internal combustion engine according to one example embodiment of the invention.

Hereinafter, one example embodiment of the internal combustion engine of the invention will be described with reference to FIGS. 1 to 7. An internal combustion engine 10 according to this example embodiment is a V-type internal combustion engine with two banks Va and Vb of cylinders. The internal combustion engine 10 includes a crank case 11 that supports a crankshaft 21, a cylinder head 12*a* that forms the bank Va, and a cylinder head 12*b* that forms the bank Vb. An oil pan 14 is attached to a lower portion of the crank case 11.

An intake camshaft 22 that drives an intake valve and an exhaust camshaft 23 that drives an exhaust valve are supported, side by side in parallel, by the cylinder head 12*a*. Similarly, an intake camshaft 22 and an exhaust camshaft 23 are supported, side by side in parallel, by the cylinder head 12*b*. That is, each of the banks Va and Vb is provided with an intake camshaft 22 and an exhaust camshaft 23 side by side.

Also, a head cover 13*a* is mounted to the cylinder head 12*a*, and a head cover 13*b* is mounted to the cylinder head 12*b*. An inlet 32 that introduces air into the head cover 13*a* is arranged in the head cover 13*a*. Meanwhile, a recirculation port 34 that discharges air that includes blow-by gas from within the head cover 13*b* is arranged in the head cover 13*b*.

Also, a chain mechanism that transmits the driving force of the crankshaft 21 to the intake camshaft 22 and the exhaust camshaft 23 is provided in the internal combustion engine 10, and a chain cover 41 that covers this chain mechanism is attached. Therefore, in the internal combustion engine 10, a space inside the head cover 13*a* is communicated with a space inside the head cover 13*b* via a space inside the chain cover 41 within which the chain mechanism is housed.

Each portion of the internal combustion engine 10 such as the chain mechanism is lubricated with oil drawn up from the oil pan 14 by an oil pump. Oil sumps that collect the oil provided to lubricate the insides of the cylinder heads 12*a* and 12*b* are provided in the cylinder heads 12*a* and 12*b*. Oil drop holes that are communicated with the crank case 11 are provided in the oil sumps, and the oil collected in the oil sumps is returned through these oil drop holes to the oil pan 14 that is attached to the lower portion of the crank case 11.

In the internal combustion engine 10, a vacuum pump 50 is arranged in the cylinder head 12*a*. This vacuum pump 50 is connected to an end portion of the intake camshaft 22 that is supported by the cylinder head 12*a*, and is driven with the rotation of the intake camshaft 22. An inlet 51 of the vacuum pump 50 is connected to a brake booster, and the vacuum pump 50 generates negative pressure to be stored in the brake booster by drawing in air from the brake booster and discharging air into the head cover 13*a*.

Moreover, a high-pressure fuel pump 60 is arranged in the head cover 13*a*. This high-pressure fuel pump 60 is driven with the rotation of the exhaust camshaft 23 that is supported by the cylinder head 12*a*. The high-pressure fuel pump 60 is a pump that pressurizes fuel and supplies this pressurized fuel to a high-pressure fuel line to which a fuel injection valve is connected. The high-pressure fuel pump 60 is arranged midway in a fuel supply passage that supplies fuel to the high-pressure fuel line from a fuel tank.

Figure 2:
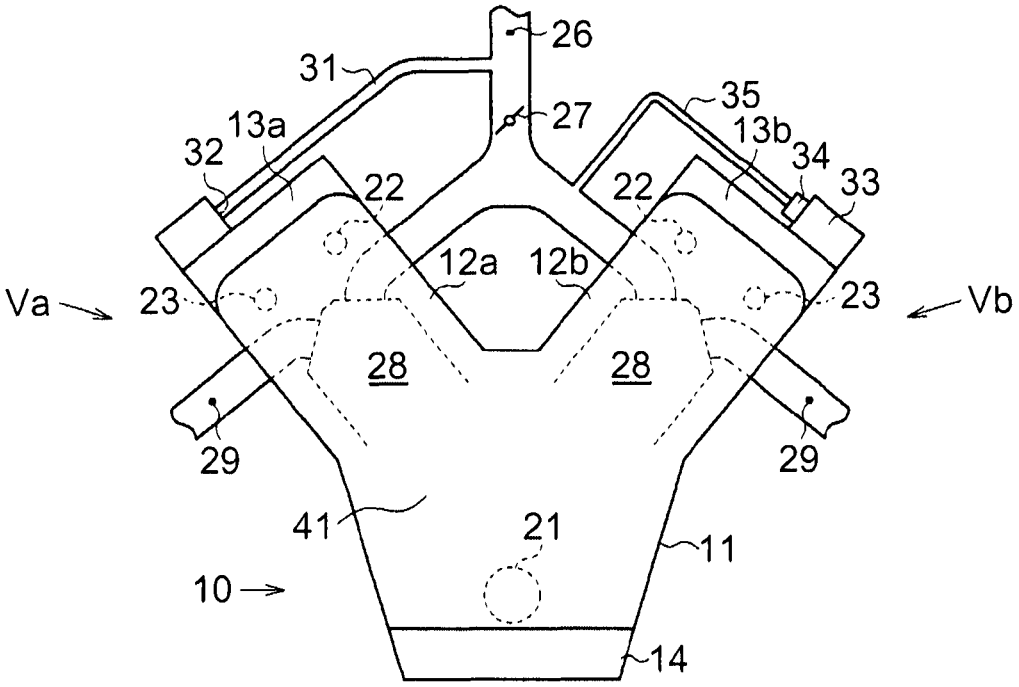
FIG. 2 is a view showing a frame format of a portion of a flow passage of intake air and exhaust gas of the internal combustion engine according to the example embodiment.

As described above, in this internal combustion engine 10, the vacuum pump 50 and the high-pressure fuel pump 60 are arranged in each bank Va and Vb. As shown in FIG. 2, combustion chambers 28 are provided in both banks Va and Vb. An intake passage 26 that introduces air into the combustion chamber 28, and an exhaust passage 29 through which exhaust gas discharged from the combustion chamber 28 flows, are connected to each combustion chamber 28. A throttle valve 27 is arranged in the intake passage 26, and a flow rate of air supplied to each combustion chamber 28 is regulated by an opening amount of this throttle valve 27.

Continuing on, a blow-by gas reduction apparatus provided in the internal combustion engine 10 will be described. One end of an introducing passage 31 is connected to a portion of the intake passage 26 that upstream of the throttle valve 27. The other end of the introducing passage 31 is connected to the inlet 32 provided in the head cover 13*a*. Also, one end of a recirculation passage 35 is connected to a portion of the intake passage 26 that is downstream of the throttle valve 27. The other end of the recirculation passage 35 is connected to the recirculation port 34 provided in the head cover 13*b*.

When the flow rate of the air supplied to the combustion chamber 28 is reduced by the throttle valve 27, pressure in the portion of the intake passage 26 that is downstream of the throttle valve 27 becomes lower than the pressure in the portion of the intake passage 26 that is upstream of the throttle valve 27.

The space inside the head cover 13*a* is communicated with the space inside the head cover 13*b* via the space inside the chain cover 41, as described above. Therefore, a flow of air from the portion of the intake passage 26 that is upstream of the throttle valve 27 toward the portion of the intake passage 26 that is downstream of the throttle valve 27 through the space inside the internal combustion engine 10 is generated by this pressure difference that is created. That is, air in the space inside the internal combustion engine 10 is drawn in through the recirculation port 34 toward the portion where the pressure is low downstream of the throttle valve 27, and air is introduced into the internal combustion engine 10 through the inlet 32 from the portion where the pressure is high upstream of the throttle valve 27. At this time, blow-by gas that has flowed out from the combustion chamber 28 mixes with the air in the process of passing through the space inside the head cover 13*a*, the space inside the chain cover 41, and the space inside the head cover 13*b*, in this order. Then, the air that includes the blow-by gas is discharged from the recirculation port 34 into the recirculation passage 35, and is recirculated to the intake passage 26 downstream of the throttle valve 27. In short, in this blow-by gas reduction apparatus of the internal combustion engine 10, a blow-by gas flow path is created such that the air that includes the blow-by gas flows from the inside of the head cover 13*a* in the bank Va to the inside of the head cover 13*b* of the bank Vb via the inside of the chain cover 41. Therefore, the bank Va is positioned on the upstream side and the bank Vb is positioned on the downstream side in this blow-by gas flow path.

An oil separator 33 for separating oil from the air that includes the blow-by gas discharged from the recirculation port 34, is provided in the head cover 13*b* provided on the cylinder head 12*b*. The air that includes the blow-by gas is discharged from the recirculation port 34 after passing through the oil separator 33. A labyrinth oil separator or a cyclone oil separator, for example, may be used as the oil separator 33. Also, a PCV valve that regulates the flow rate of air discharged from the space inside the head cover 13*b* into the recirculation passage 35 may also be provided in the recirculation port 34.

Figure 3:
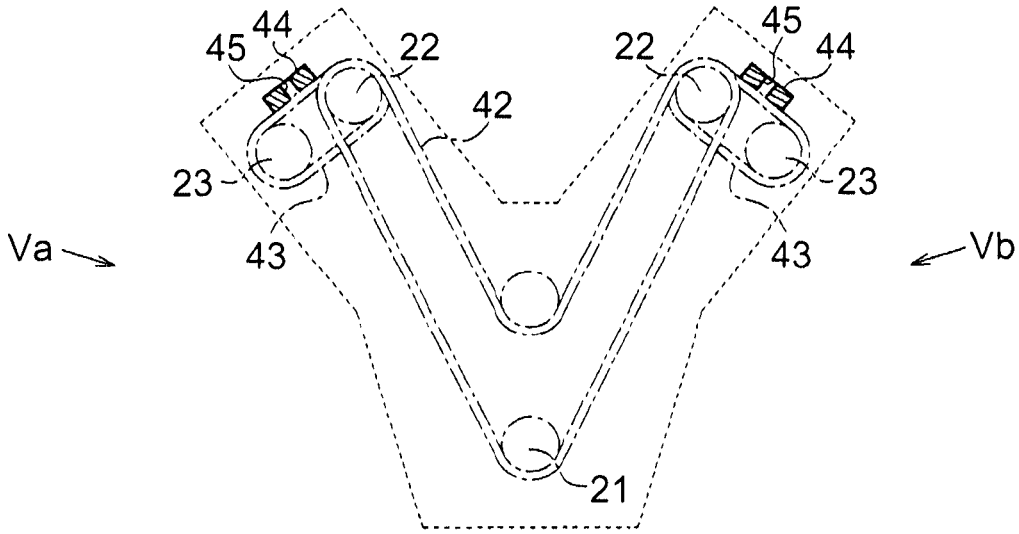
FIG. 3 is a view showing a frame format of a chain mechanism of the internal combustion engine according to the example embodiment.

Next, the chain mechanism provided inside the chain cover 41 will be described with reference to FIG. 3. The chain mechanism includes two chains 43 and one chain 42.

The chain 42 is wound around a sprocket of the intake camshaft 22 arranged in the bank Va, a sprocket of the intake camshaft 22 arranged in the bank Vb, and a sprocket of the crankshaft 21, thereby operatively linking the crankshaft 21 with the intake camshaft 22 of each bank Va and Vb.

The chain 43 provided in each bank Va and Vb is wound around the sprocket of the intake camshaft 22 and the sprocket of the exhaust camshaft 23 in each bank Va and Vb, operatively linking the intake camshaft 22 and the exhaust camshaft 23 together in each bank Va and Vb.

A chain tensioner 44 as a chain guide that guides the chain 43 is arranged between the intake camshaft 22 and the exhaust camshaft 23 in each bank Va and Vb. This chain tensioner 44 is formed in a rail-shape provided with a guide groove, and guides the chain 43 by sliding the chain 43 in the guide groove. Also, a discharge hole 45 is open in a bottom portion of the guide groove of the chain tensioner 44, and oil that lubricates the chain 43 is discharged from the discharge hole 45 into the space inside the chain cover 41.

The movement of the crankshaft 21 is transmitted to the intake camshaft 22 and the exhaust camshaft 23 by this chain mechanism. Next, the vacuum pump 50 will be described with reference to FIGS. 4 and 5.

Figure 4:
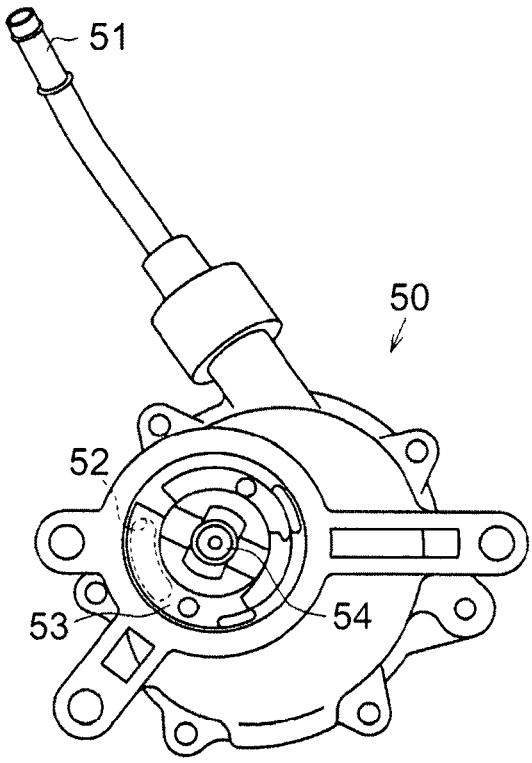
FIG. 4 is a plan view of a vacuum pump according to the example embodiment.

As shown in FIG. 4, the vacuum pump 50 includes a drive shaft 54. This drive shaft 54 is connected to the end portion of the intake camshaft 22 that is supported by the cylinder head 12*a*, and is driven with the rotation of the intake camshaft 22. Also, the vacuum pump 50 includes an inlet 51 that draws in air, and an outlet 52 that discharges air. The inlet 51 is connected to a brake booster.

The vacuum pump 50 draws in air from the brake booster via the inlet 51, and generates negative pressure by discharging air from the outlet 52 into the head cover 13*a*. Furthermore, a valve body formed by a plate spring that closes off the outlet 52 is provided in the vacuum pump 50.

When the drive shaft 54 rotates, an air chamber divided by a vane attached to the drive shaft 54 moves while changing the volume. More specifically, the air chamber gradually increases in volume as the drive shaft 54 rotates while the air chamber is communicated with the inlet 51 and not the outlet 52. Meanwhile, the air chamber gradually decreases in volume as the drive shaft 54 rotates while the air chamber is communicated with the outlet 52 and not the inlet 51. Air is drawn in from the inlet 51, and the drawn in air is compressed and discharged from the outlet 52, by this increase and decrease in the volume of the air chamber as the drive shaft 54 rotates. The outlet 52 is closed off by the valve body formed by the plate spring, so when the valve body is bent by the pressure of the air that is compressed as the volume of the air chamber decreases, the outlet 52 opens and the air is discharged. That is, this vacuum pump 50 intermittently discharges the air that has been drawn in from the inlet 51, from the outlet 52.

Figure 5:
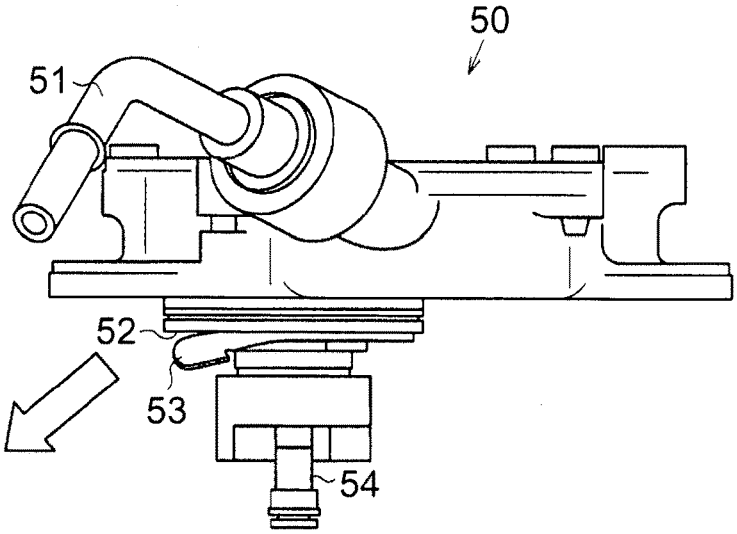
FIG. 5 is a top view of the vacuum pump according to the example embodiment.

Moreover, a plate-like stopper 53 for restricting the opening amount of the outlet 52 by regulating the bend of the valve body to within a certain range is provided in the vacuum pump 50. As shown in FIG. 5, the stopper 53 is provided such that one end is fixed to a housing of the vacuum pump 50, and the other end is separated from the housing of the vacuum pump 50.

When air is discharged from the outlet 52 of the vacuum pump 50, oil that lubricates the inside of the vacuum pump 50 is discharged together with the air. This oil is discharged all at once from the outlet 52 together with the air that has been pressurized inside the air chamber of the vacuum pump 50, and thus forms a mist with a significantly small particle diameter. At this time, the stopper 53 that regulates the bend of the valve body is provided, so the discharged oil mist is diffused into a space in the direction indicated by the arrow shown in FIG. 5.

Figure 6:
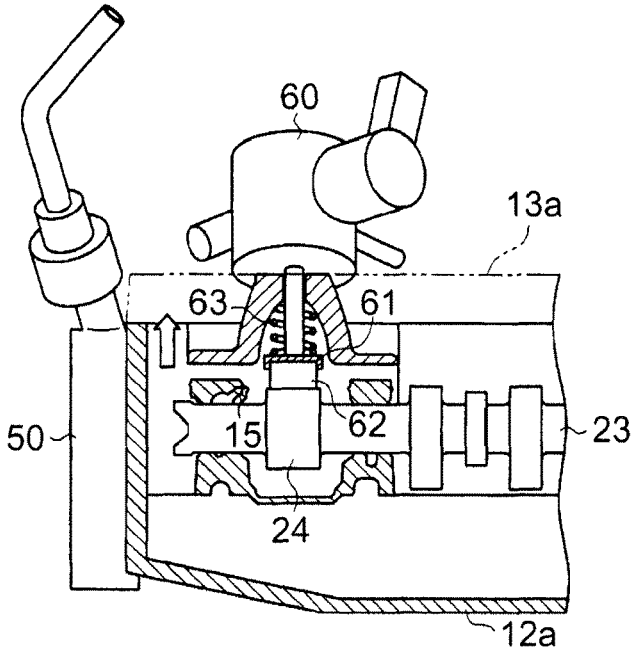
FIG. 6 is a sectional view of a cylinder head according to the example embodiment.

Next, the high-pressure fuel pump 60 will be described with reference to FIG. 6. The high-pressure fuel pump 60 houses a vertically movable plunger 61. In the high-pressure fuel pump 60, the volume of a pressure chamber increases and decreases by moving the movable plunger 61 up and down. Also, fuel introduced into the pressure chamber is pressurized and delivered using the increase and decrease in the volume of this pressure chamber.

The plunger 61 has a movable roller 62 on a tip end thereof. The high-pressure fuel pump 60 is arranged such that the roller 62 abuts against a pump drive cam 24 provided on the exhaust camshaft 23. Also, the plunger 61 is urged toward the center of the pump drive cam 24 by a spring 63.

That is, the plunger 61 moves up and down in a cyclic manner as the exhaust camshaft 23 rotates. The high-pressure fuel pump 60 is driven, such that pressurized fuel is supplied to the high-pressure fuel line, by the driving force of the exhaust camshaft 23 being transmitted to the high-pressure fuel pump 60 in this way.

The abutting portions of the roller 62 and the pump drive cam 24 are lubricated by oil discharged from a lubricating oil supply port 15 provided in the cylinder head 12*a*. Oil adhered to the pump drive cam 24 is dispersed (i.e., flies around) inside the head cover 13*a* as the pump drive cam 24 rotates. The dispersed oil collides with the inside wall of the head cover 13*a* and the inside wall of the cylinder head 12*a*, and the spray produced when the dispersed oil collides with these walls forms an oil mist, which rises inside the head cover 13*a* as indicated by the arrow shown in FIG. 6, and stagnates in the space inside the head cover 13*a*.

Figure 7:
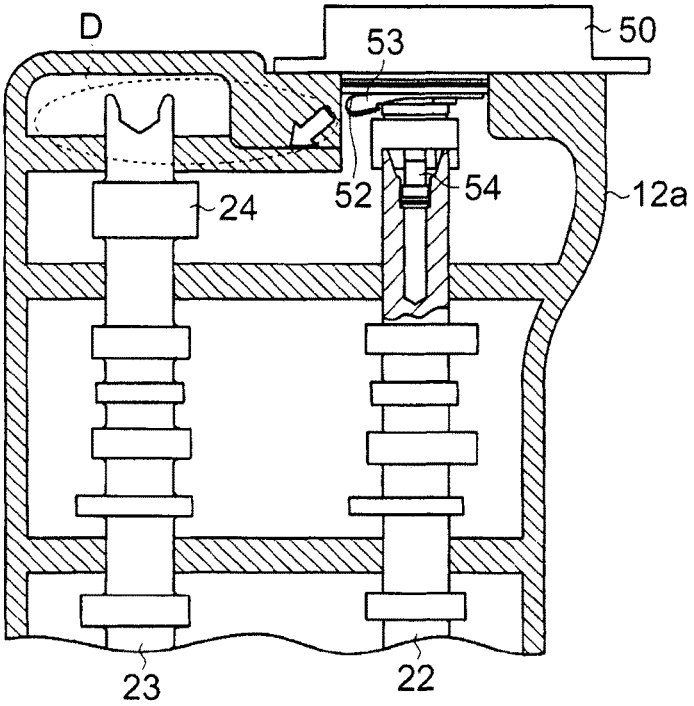
FIG. 7 is a sectional view of the structure of the cylinder head according to the example embodiment, at an area around the vacuum pump and a high-pressure fuel pump, as viewed from a head cover side.

As shown in FIG. 7, the vacuum pump 50 is provided such that the outlet 52 is positioned inside the head cover 13*a*. Also, the pump drive cam 24 that is a cam that drives the high-pressure fuel pump 60 is the cam that is positioned closest to the vacuum pump 50, from among a plurality of cams provided on the exhaust camshaft 23. Region D indicated by the broken line represents a space where the oil mist formed by oil dispersed by the pump drive cam 24 described above stagnates. The vacuum pump 50 is arranged such that the oil mist discharged from the outlet 52 is discharged toward this region D. That is, the vacuum pump 50 is arranged such that the oil mist discharged from the outlet 52 is discharged toward the space where the oil mist formed by the oil dispersed by the pump drive cam 24 stagnates.

Next, the operation of the internal combustion engine 10 according to this example embodiment will be described with reference to FIGS. 1 and 7. As shown in FIG. 7, in this internal combustion engine 10, the outlet 52 of the vacuum pump 50 is arranged in a position where the oil mist discharged from the outlet 52 of the vacuum pump 50 is discharged toward the region D where the oil mist formed by the oil dispersed by the pump drive cam 24 stagnates. Therefore, the oil mist with a small particle diameter that is discharged together with air from the outlet 52 of the vacuum pump 50 is able to collide with the oil mist formed by the oil that is dispersed by the pump drive cam 24 that drives the high-pressure fuel pump 60.

Moreover, as shown in FIG. 1, the vacuum pump 50 is arranged in the cylinder head 12*a*, i.e., the bank Va, so the vacuum pump 50 is arranged upstream of the blow-by gas flow path formed in the internal combustion engine 10. Therefore, the oil mist discharged from the vacuum pump 50 flows through the blow-by gas flow path together with the air that flows through the blow-by gas flow path. Thus, the oil mist that did not collide with the oil mist formed by the oil dispersed by the pump drive cam 24 that drives the high-pressure fuel pump 60 is able to collide with droplets of other oil while flowing through the blow-by gas flow path, the inside walls of the head covers 13*a* and 13*b*, and the inside wall of the chain cover 41, and the like.

In particular, in this example embodiment, the blow-by gas flow path is formed passing through the chain cover 41. Therefore, the oil mist discharged from the vacuum pump 50 is able to collide with the oil discharged from the discharge hole 45 of the chain tensioner 44. The amount of oil used to lubricate the chains 42 and 43 is greater than that used at other lubricating points in the internal combustion engine 10, and the droplets of oil dispersed by the chain tensioner 44 have a relatively large particle diameter. Therefore, the particle diameter of the oil mist is able to be made larger by making these droplets of oil collide with the oil mist discharged from the vacuum pump 50.

That is, particle diameter of the oil mist discharged from the vacuum pump 50 becomes larger by this oil mist colliding with other oil and the inside walls and the like. Also, oil that has become larger in particle diameter and liquefied accumulates in the oil pan 14 through the oil drop holes after being collected in the oil sumps in the cylinder heads 12*a* and 12*b*. Also, oil mist that did not liquefy even though the particle diameter became larger flows together with air through the blow-by gas flow path, and is separated from the air by the oil separator 33 provided in the blow-by gas reduction apparatus, and collected.

According to the example embodiment described above, the effects described below are able to be obtained. (1) An oil mist with a small particle diameter that is discharged together with air from the outlet 52 of the vacuum pump 50 is discharged toward the space where an oil mist with a large particle diameter is accumulated. As a result, the oil mists collide with each other, so the particle diameter of the oil mist with the small particle diameter will become larger. Therefore, the oil mist that is discharged from the vacuum pump 50 becomes easier to collect.

(2) The air and oil mist discharged from the vacuum pump 50 are able to collide with the oil mist formed by the oil dispersed by the pump drive cam 24 that drives the high-pressure fuel pump 60. Therefore, the liquefaction of the oil dispersed by the pump drive cam 24 is able to be promoted, and the oil mist formed by the oil dispersed by the pump drive cam 24 is also able to be collected more easily. That is, both the oil mist discharged from the vacuum pump 50 and the oil mist formed by the oil dispersed by the pump drive cam 24 are able to be collected.

(3) The vacuum pump 50 and the high-pressure fuel pump 60 are arranged in the bank Va. Therefore, the space where the oil mist formed by the oil dispersed by the pump drive cam 24 that drives the high-pressure fuel pump 60 and the position where the vacuum pump 50 is arranged are closer together. That is, the air and oil mist discharged from the vacuum pump 50 and the oil mist formed by the oil dispersed by the pump drive cam 24 are more apt to collide, so the oil is able to be collected more easily.

(4) The vacuum pump 50 is arranged in the cylinder head 12*a* that forms the bank Va provided with the inlet 32. Therefore, oil mist discharged from the vacuum pump 50 but which did not collide with the oil mist formed by the oil dispersed by the pump drive cam 24 that drives the high-pressure fuel pump 60 will flow through the blow-by gas flow path, together with the air that flows through the blow-by gas flow path. That is, this oil mist will flow from inside the head cover 13*a* of the bank Va provided with the inlet 32 into the head cover 13*b* in the other bank Vb via the inside of the chain cover 41. As a result, oil mist that did not collide with the oil mist formed from the oil dispersed by the pump drive cam 24 that drives the high-pressure fuel pump 60 will collide with droplets of other oil while flowing through the blow-by gas flow path, the inside walls of the head covers 13*a* and 13*b*, and the inside wall of the chain cover 41, and the like, such that the particle diameter will become larger and the oil mist will more easily liquefy. Therefore, oil that did not collide with the oil mist formed by the oil dispersed by the pump drive cam 24 that drives the high-pressure fuel pump 60 will also be more easily collected.

(5) Droplets of oil with a large particle diameter discharged from the discharge hole 45 of the chain tensioner 44 are able to be made to collide with the oil mist that has flowed through the blow-by gas flow path together with the air. That is, the oil mist discharged from the vacuum pump 50 is able to be collected more easily, and the liquefaction of oil discharged from the discharge hole 45 of the chain tensioner 44 is able to be promoted, thus enabling the recovery of oil discharged from the discharge hole 45 of the chain tensioner 44 to be promoted.

The example embodiment described above may also be carried out in the modes described below that have been suitably modified.—In the example embodiment described above, oil is discharged into the blow-by gas flow path from the discharge hole 45 of the chain tensioner 44. Also, the oil mist discharged from the vacuum pump 50 flows through the blow-by gas flow path, and is able to collide with the oil discharged from the discharge hole 45. However, with the chain mechanism, oil may be dispersed, regardless of whether oil is discharged from the discharge hole 45 of the chain tensioner 44. Such oil dispersed by the chain mechanism may also be made to collide with the oil mist discharged from the vacuum pump 50. That is, an effect similar to that obtained by the example embodiment described above may also be displayed with the chain tensioner 44 that does not have the discharge hole 45 formed in it. Therefore, it is not always necessary to provide the discharge hole 45 in the chain tensioner 44.

Also, an effect similar to that obtained by the example embodiment described above may also be displayed by making oil dispersed from something in the blow-by gas flow path other than the chain mechanism collide with the oil mist discharged from the vacuum pump 50. Therefore, the chain tensioner 44 is not an essential structure, and may be omitted.

The internal combustion engine 10 according to the example embodiment described above is a V-type internal combustion engine, but the internal combustion engine 10 may also be an in-line internal combustion engine, for example. The vacuum pump 50 need only be arranged so as to discharge oil mist toward the region where the oil mist formed by the oil dispersed from the pump drive cam 24 stagnates, regardless of the type of the internal combustion engine. Also, the vacuum pump 50 and the high-pressure fuel pump 60 are able to be arranged similar to the example embodiment described above if the intake camshaft 22 and the exhaust camshaft 23 are supported next to each other inside the cylinder head.

In the example embodiment described above, the vacuum pump 50 is connected to the intake camshaft 22, and the high-pressure fuel pump 60 is connected to the exhaust camshaft 23, but the invention is not limited to this combination. For example, the high-pressure fuel pump 60 may be connected to the intake camshaft 22, and the vacuum pump 50 may be connected to the exhaust camshaft 23.

In the example embodiment described above, the vacuum pump 50 is connected to the intake camshaft 22, and the high-pressure fuel pump 60 is connected to the exhaust camshaft 23, but the vacuum pump 50 and the high-pressure fuel pump 60 may both be connected to the same camshaft. In order to obtain an effect similar to that obtained by the example embodiment described above, the vacuum pump 50 need simply be arranged so as to discharge oil mist toward the region where oil mist formed by oil dispersed by the pump drive cam 24 stagnates.

According to the structure described above, the effect in which oil mist with a small particle diameter that is discharged from the vacuum pump 50 is more easily collected, similar to the example embodiment described above, is able to be obtained even in an internal combustion engine in which the intake camshaft 22 and the exhaust camshaft 23 are not supported next to each other in the cylinder head. Also, the vacuum pump 50 and the high-pressure fuel pump 60 are able to be arranged such that the effect in which oil mist with a small particle diameter that is discharged from the vacuum pump 50 is more easily collected, is able to be obtained even in an internal combustion engine provided with a camshaft that drives both the intake valve and the exhaust valve.

In the example embodiment described above, the vacuum pump 50 is arranged near the high-pressure fuel pump 60, and oil mist with a small particle diameter that is discharged from the vacuum pump 50 is made to collide with oil mist formed by oil dispersed by the pump drive cam 24 that drives the high-pressure fuel pump 60. However, the vacuum pump 50 does not always have to be arranged near the high-pressure fuel pump 60.

That is, the oil mist with a small particle diameter that is discharged from the vacuum pump 50 need only be able to collide with the oil mist having a large particle diameter formed by oil dispersed by the pump drive cam 24 that drives the high-pressure fuel pump 60. This kind of structure enables the effect in which the oil mist with a small particle diameter that is discharged from the vacuum pump 50 is able to be more easily collected, just as in the example embodiment described above, to be obtained.

What is claimed is:

1. An internal combustion engine comprising:

a camshaft;

a first cylinder head that supports the camshaft such that the camshaft rotates;

a first head cover mounted to the first cylinder head;

a high-pressure pump that includes a plunger that abuts against a cam provided on the camshaft, the high-pressure pump configured to be driven by rotation of the cam such that oil that has lubricated abutting portions of the cam and the plunger collides with an inside wall of the first head cover;

a vacuum pump mounted to the first cylinder head, the vacuum pump including an inlet and an outlet, the vacuum pump configured to draw in air from the inlet and discharge an oil mist with air from the outlet, the outlet arranged such that the oil mist with air from the outlet is discharged into a space where an oil mist formed by a spray of oil that is dispersed by the cam and that has collided with the inside wall of the first head cover stagnates.

2. The internal combustion engine according to claim 1, wherein the camshaft includes an intake camshaft that drives an intake valve and an exhaust camshaft that drives an exhaust valve;

the first cylinder head supports the intake camshaft and the exhaust camshaft side by side;

the vacuum pump is connected to one end of one camshaft, from among the intake camshaft and the exhaust camshaft; and the high-pressure pump is driven by a cam arranged in a position closest to the vacuum pump, from among a plurality of cams provided on a remaining one from among the intake camshaft and the exhaust camshaft.

3. The internal combustion engine according to claim 2, further comprising:

a chain that drives the intake camshaft and the exhaust camshaft; and a chain cover that covers the chain, wherein two cylinder heads comprising the first cylinder head and a second cylinder head are provided, two head covers comprising the first head cover and a second head cover are provided;

the chain operatively links a plurality of camshafts provided in each of the two cylinder heads;

one of the two head covers includes an inlet that introduces air in from a portion of an intake passage that is upstream of a position where a throttle valve is provided in the intake passage;

a remaining one of the two head covers includes a recirculation port that discharges blow-by gas to a portion of the intake passage that is downstream of the throttle valve in the intake passage, such that blow-by gas flows from the inlet formed in the one of the two head covers to the recirculation port of the remaining one of the two head covers via inside of the chain cover.

4. The internal combustion engine according to claim 3, further comprising:

a chain guide that guides the chain, the chain guide including a discharge hole, the discharge hole configured to discharge droplets of oil supplied to lubricate sliding surfaces of the chain and the chain guide into the chain cover through which the blow-by gas flows.

* * * * *